US006981908B2

(12) United States Patent
Enomoto et al.

(10) Patent No.: US 6,981,908 B2
(45) Date of Patent: Jan. 3, 2006

(54) FERRULE POLISHING CONTROL MACHINE, FERRULE POLISHING METHOD, AND FERRULE POLISHING COMPUTER PROGRAM

(75) Inventors: Yoshitaka Enomoto, Chiba (JP); Kouji Minami, Chiba (JP); Junji Taira, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/970,202

(22) Filed: Oct. 21, 2004

(65) Prior Publication Data

US 2005/0085170 A1 Apr. 21, 2005

Related U.S. Application Data

(62) Division of application No. 10/194,644, filed on Jul. 12, 2002, now Pat. No. 6,814,651.

(30) Foreign Application Priority Data

Jul. 13, 2001 (JP) ..... 2001-214310
Jul. 12, 2002 (JP) ..... 2002-203739

(51) Int. Cl.
*B24B 1/00* (2006.01)

(52) U.S. Cl. ..... 451/10; 451/11; 451/41; 451/271; 451/159

(58) Field of Classification Search ..... 451/41, 451/53, 63, 159, 271, 533, 59, 270, 509, 451/9, 10, 11

See application file for complete search history.

(56) References Cited

U.S. PATENT DOCUMENTS 4,979,334 A * 12/1990 Takahashi ..... 451/271
5,127,196 A * 7/1992 Morimoto et al. ..... 451/7
5,458,531 A * 10/1995 Matsuoka et al. ..... 451/259
5,516,328 A * 5/1996 Kawada ..... 451/259
5,601,474 A * 2/1997 Takahashi ..... 451/28
6,077,154 A * 6/2000 Takashi et al. ..... 451/271
6,102,785 A * 8/2000 Chandler et al. ..... 451/271
6,280,293 B1 * 8/2001 Minami et al. ..... 451/10
6,309,284 B1 * 10/2001 Chou et al. ..... 451/65

* cited by examiner

*Primary Examiner*—Eileen P. Morgan
(74) *Attorney, Agent, or Firm*—Adams & Wilks

(57) ABSTRACT

A ferrule polishing control machine has a ferrule type input part for selecting one type of ferrule from various ferrule types stored in a computer. A ferrule end face shape input part selects one type of ferrule end face shape from various types of ferrule end face shapes stored in the computer. A connector type input part selects one type of connector from various connector types stored in the computer. A ferrule polishing number input part selects from ferrule polishing numbers stored in the computer a number of ferrules to be mounted on a polishing jig for a polishing operation. A transmitting part selects polishing pressure information stored in the computer in accordance with polishing information inputted from the ferrule type input part, the ferrule end face shape input part, the connector type input part, and the ferrule polishing number input part, and transmits the polishing pressure information to a ferrule polishing machine.

6 Claims, 5 Drawing Sheets

FERRULE POLISHING CONTROL MACHINE, FERRULE POLISHING METHOD, AND FERRULE POLISHING COMPUTER PROGRAM

CROSS REFERENCE TO RELATED APPLICATIONS

The present application is a division of U.S. application Ser. No. 10/194,644, filed on Jul. 12, 2002, now U.S. Pat. No. 6,814,651 which is hereby incorporated by reference, and priority thereto for common subject matter is hereby claimed.

BACKGROUND OF THE INVENTION

Field of the Invention

The present invention relates generally to polishing machines and methods and, more specifically, to a polishing control machine, a polishing method, and a polishing computer program for polishing end faces of a rod-shaped members, such as ferrules.

For end face polishing machines traditionally used for polishing the end face of ferrules, a machine has been known in which a polishing jig fixed with ferrules is disposed on a rotary and revolutionary polishing plate for polishing. In addition, ferrule polishing has been conducted according to a plurality of steps having different process conditions from a rough surface state to a final finish state.

However, the traditional polishing machine has conducted input control for polishing and polishing conditions by a single machine. Thus, it has been difficult to change the polishing conditions varied from each of a plurality of ferrules and the conditions for each of polishing steps, to adjust conditions according to changes in the number of ferrules and to input data, because of the size of the overall machine and the configuration of indication and input.

Therefore, skilled workers have to manipulate operations of the polishing machine, thereby hindering the production of a wide variety of products.

Traditionally, the correction operation for the polishing conditions takes effort and time because a user stops and manipulates the machine at each event. Errors in correction tend to occur, and yields in products are reduced as well. There have been problems that the user has to stay the position to know the number of products, the kinds of ferrules and the operation status of the polishing machine, and that investigations for causes are not simple when defects are generated in products because correction conditions are not recorded.

In view of the foregoing drawbacks in the conventional art, it is an object of the invention to provide an end face polishing system of ferrules capable of configuring a system for polishing a plurality of various types of ferrules under a plurality of process conditions, shortening input time for the process conditions of polishing steps, storing the process conditions, and structuring a LAN system allowing a plurality of machines to remotely operated.

SUMMARY OF THE INVENTION

According to the present invention, a polishing system has a polishing machine and a computer. The polishing machine includes a polishing plate, a pressing part for pressing the end face of a rodshaped member onto a polishing sheet disposed over the polishing plate, and a pressing force control part for controlling the pressure of the pressing part, and the computer is connected to the polishing machine with a communication line for transmitting pressing force information to the pressing force control part.

DETAILED DESCRIPTION OF THE PREFERRED EMBODIMENTS

Figure 1:
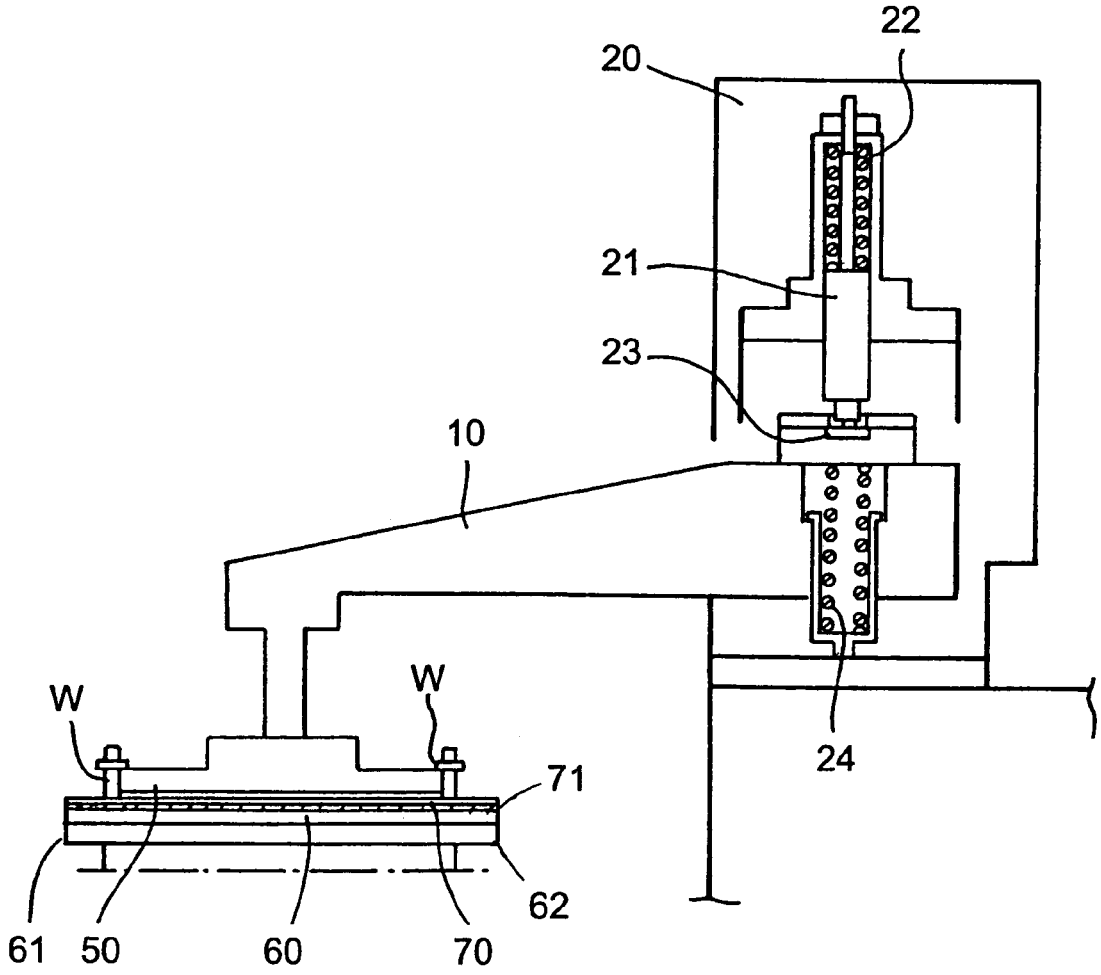
FIG. 1 is a diagram illustrating a polishing system of the invention.

In the invention, an end face polishing machine has been configured as a first embodiment, the end face polishing machine includes:

a jig for supporting at least one rod-shaped member;

a polishing plate performing rotary and revolutionary movement;

a polishing sheet disposed over the polishing plate for polishing the end face of the rod-shaped member;

a pressing part for pressing the end face of the rod-shaped member onto the polishing member, a pressing force control part for controlling a pressure of the pressing part, and a pressing force information input part for inputting a pressing force set value to the pressing force control part through a communication line.

Furthermore, as a second embodiment, the first embodiment can be added with a pressure detecting part for detecting the pressure in pressing, and a pressing force information output part for outputting pressure information of the pressure detecting part through the communication line.

As a third embodiment, it is the end face polishing machine in which the pressing force set value is a pressure in pressing and pressing time in the first or second embodiment.

As a fourth embodiment, it is a ferrule polishing control machine including:

a ferrule type input part for selecting one ferrule from a plurality of ferrule types stored in a computer beforehand;

an end face shape input part for selecting one end face shape from a plurality of ferrule end face shapes stored in the computer beforehand;

a connector type input part for selecting one connector from a plurality of connector types stored in the computer beforehand;

a polishing number input part for selecting the number of ferrules to be mounted on a polishing jig from numbers stored in the computer beforehand; and a transmitting part for selecting polishing pressure information stored in the computer according to polishing information inputted from the ferrule type input part, the end face shape input part, the connector type input part, and the polishing number input part, and for transmitting the polishing pressure information to a ferrule polishing machine.

As a fifth embodiment, a ferrule polishing method includes the steps of:

selecting one ferrule from a plurality of ferrule types stored in a computer beforehand;

selecting one end face shape from a plurality of ferrule end face shapes stored in the computer beforehand;

selecting one connector from a plurality of connector types stored in the computer beforehand;

selecting the number of ferrules to be mounted on a polishing jig from numbers stored in the computer beforehand; and selecting polishing pressure information stored in the computer beforehand according to polishing information inputted from the unit adapted to input a ferrule type, the unit adapted to select an end face shape, the unit adapted to input a connector type, and the unit adapted to input a polishing number, and for performing ferrule end face polishing.

As a sixth embodiment, it is a ferrule polishing program including the steps of:

selecting one ferrule from a plurality of ferrule types stored in a computer beforehand;

selecting one end face shape from a plurality of ferrule end face shapes stored in the computer beforehand;

selecting one connector from a plurality of connector types stored in the computer beforehand;

selecting the number of ferrules to be mounted on a polishing jig from numbers stored in the computer beforehand; and selecting polishing pressure information stored in the computer according to polishing information inputted from the unit adapted to input a ferrule type, the unit adapted to select an end face shape, the unit adapted to input a connector type, and the unit adapted to input a polishing number, and for performing ferrule end face polishing.

As a seventh embodiment of the invention, it is an end face polishing machine including:

a jig for supporting at least one rod-shaped member;

a polishing plate performing rotary and revolutionary movement;

a polishing sheet disposed over the polishing plate for polishing the end face of the rod-shaped member;

a pressing part for pressing the end face of the rod-shaped member onto the polishing member;

an elastic member between the polishing sheet and the polishing plate; and a temperature control unit adapted to control the elastic member.

As an eighth embodiment, the temperature control unit is a heating unit in the seventh embodiment.

As a ninth embodiment, the temperature control unit is a cooling unit in the seventh embodiment.

Furthermore, the invention has a polishing system including a polishing machine and a computer, the polishing machine including:

a polishing plate;

a pressing part for pressing the end face of a rod-shaped member onto a polishing sheet disposed over the polishing plate; and a pressing force control part for controlling a pressure of the pressing part, and the computer connected to the polishing machine with a communication line.

Moreover, in the foregoing polishing system, wherein the computer indicates set values and actual measurements for pressure in pressing controlled by the pressing force control part.

In the foregoing polishing system, the computer controls set values for pressure in pressing controlled by the pressing force control part.

In the foregoing polishing system, the computer has a unit adapted to input the number of the rod-shaped members and a unit adapted to indicate the number inputted.

In the foregoing polishing system, the computer has a unit adapted to input and indicate a connector type for disposing the rodshaped member.

In the foregoing polishing system, the computer has a unit adapted to input and indicate a type indicating the shape of the rod-shaped member and a shape, and a unit adapted to indicate the type and the shape.

In the foregoing polishing system, the computer has a unit adapted to input and an end face shape of the rodshaped member and a unit adapted to indicate it.

In the foregoing polishing system, the computer has a unit adapted to input and indicate a process condition for a plurality of polishing steps.

In the foregoing polishing system, the process condition is polishing time.

In the foregoing polishing system, the process condition is an indication to indicate a step being implemented among the plurality of polishing steps.

In the foregoing polishing system, the process condition is remaining time for the polishing step.

In the foregoing polishing system, the process condition is a pressure in pressing.

In the foregoing polishing system, the process condition is an actual measurement for pressure in pressing.

In the foregoing polishing system, the process condition is the rotation number of the polishing plate.

Another end face polishing machine comprises:

a polishing plate having a polishing sheet over the top face; and a heating unit for heating the polishing sheet.

The end face polishing machine includes a polishing plate having a polishing sheet over the top face and a heating unit for heating the polishing sheet, and a method of controlling the hardness of the polishing sheet by the heating unit has been used.

Another polishing machine comprises:

a unit adapted to periodically change a pressure of pressing the end face of rodshaped member onto a polishing sheet; and a unit adapted to detect a difference between the pressure in pressing and the pressure applied.

In the foregoing polishing machine, the difference is a difference in magnitudes or pressure. It has been the polishing machine, wherein the difference is a phase difference of pressure.

Another polishing machine comprises:

a unit adapted to periodically change a recessed amount for pressing an end face of a rodshaped member onto a polishing sheet in the thickness direction of the polishing sheet; and a unit adapted to detect a difference between the recessed amount and the pressure applied.

Figure 2:
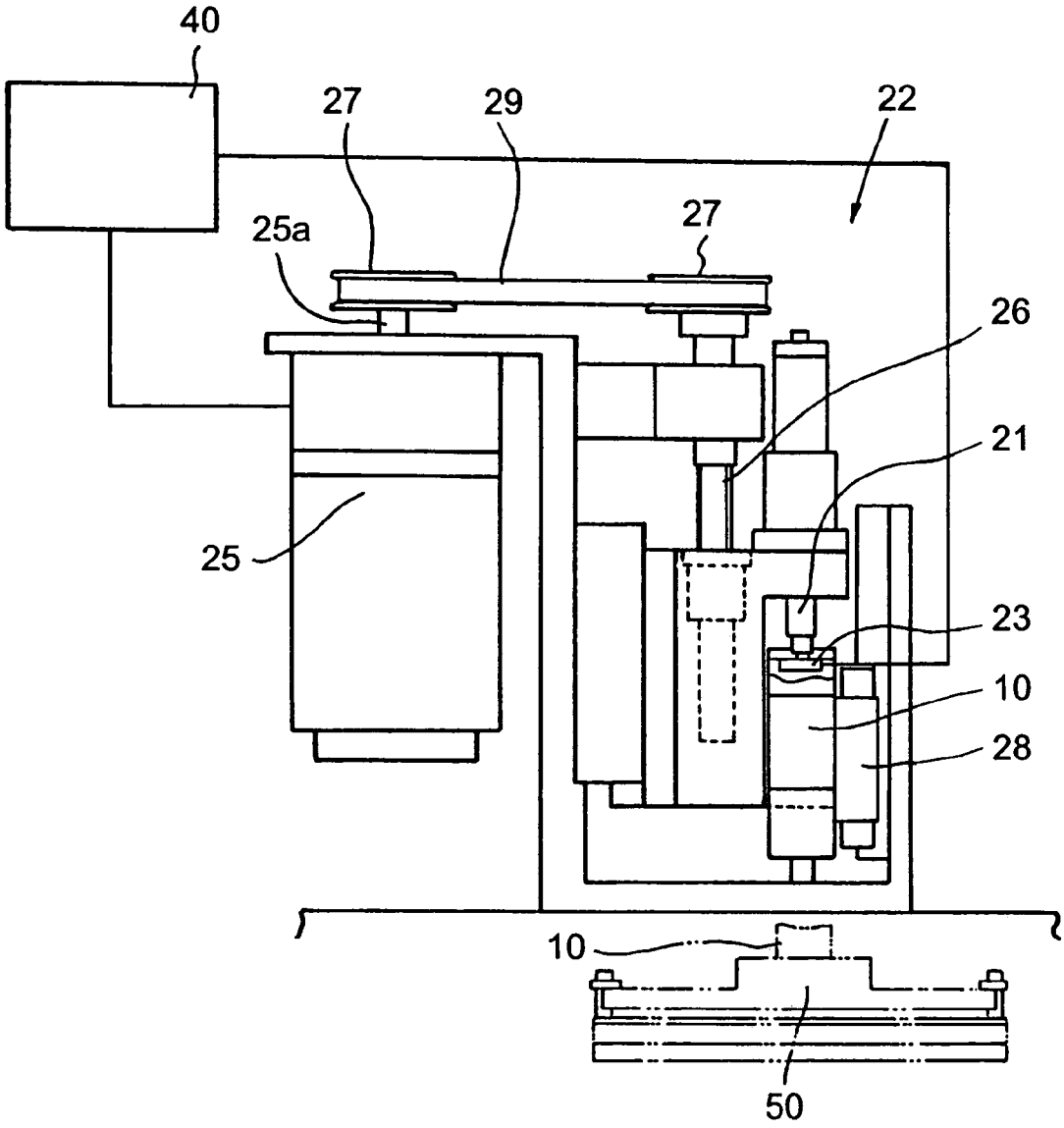
FIG. 2 is a diagram illustrating the polishing system of the invention.
Figure 3:
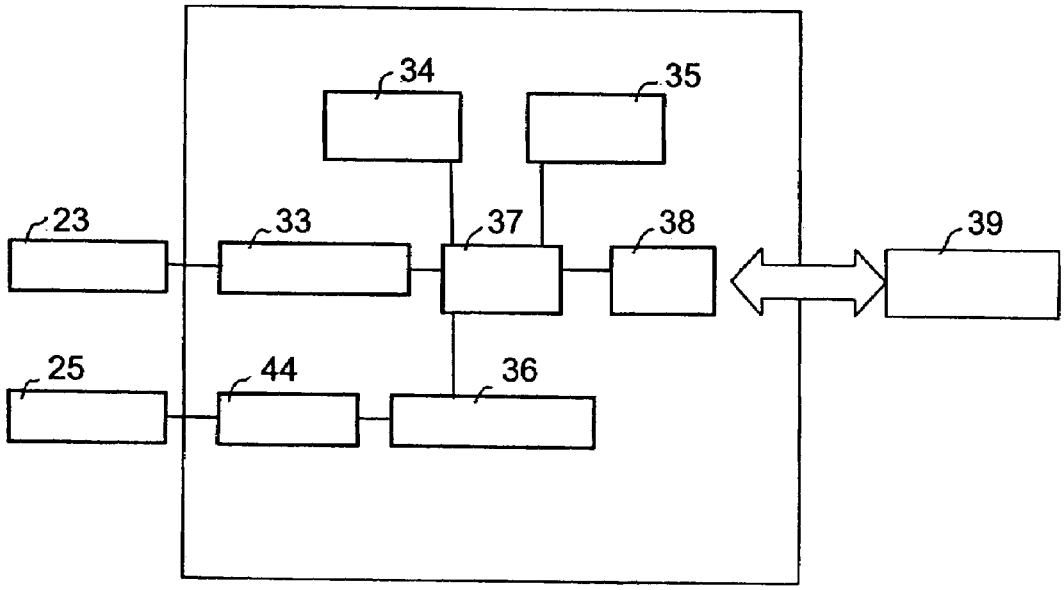
FIG. 3 is a block diagram illustrating a pressing force control part of the invention.
Figure 4:
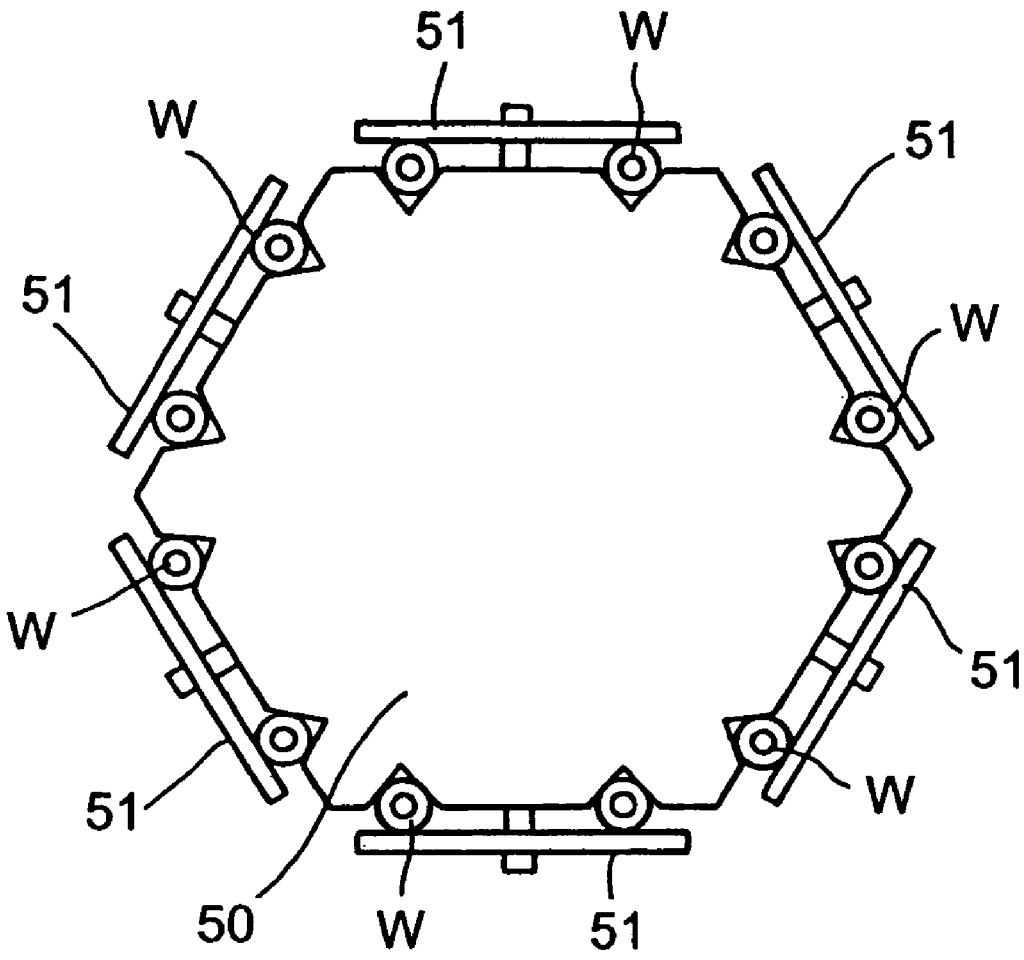
FIG. 4 is a diagram illustrating the top face of a jig plate of the invention.

Hereafter, embodiments of the invention will be described in accordance with the drawings in detail. FIG. 1 is a front view illustrating an end face polishing machine in one embodiment of the invention. FIG. 2 is a side view illustrating the end face polishing machine in one embodiment of the invention. FIG. 3 is a block diagram illustrating a pressing force control part of the end face polishing machine in one embodiment of the invention. FIG. 4 is a plan view illustrating the state that workpieces, such as ferrules, are fixed to a jig plate of the end face polishing machine in one embodiment of the invention.

In FIG. 1, over the top face of a polishing plate 60 moved by one kind of a combination of rotation, revolution and oscillation, an elastically deformable polishing sheet 70 is placed, and an elastic member 71 is disposed between the polishing plate 60 and the polishing sheet 70. The polishing plate 60, polishing sheet 70, and elastic member 71 define a polishing structure which undergo the combination of movements as set forth above during a polishing operation. Then, on the upper part of the polishing sheet 70, a jig plate 50 for detachably fixing ferrules W to both ends is placed so as to contact the end face of the ferrules W to the surface of the polishing sheet 70. Here, the jig plate 50 is connected to one end of a lever 10 and pressed downward, and the end face of the ferrules W is pressed onto the polishing sheet.

Subsequently, near the end part opposed to the end part of the lever 10 connected to the jig plate 50, a lower spring 24 for pushing up the lever 10 from under is placed. Then, above the position facing to the lower spring 24 of the lever 10, a pressure sensor 23 for detecting pressure applied to the jig plate 50 is placed. Here, a load cell is used as the pressure sensor.

The lower end part of a pressing head 21 is placed so as to contact the top face of the pressure sensor 23. Above the pressing head 21, an upper spring 22 for pressing the pressing head 21 is placed.

In the invention, the top face and the lower face of the lever 10 are pressed by the lower spring 24 and the upper spring 22, respectively. Thus, the lower spring 24 allows the load of the lever 10 or the load combined with the lever 10 and the jig plate 50 to be cancelled to achieve zero balance. Consequently, the pressure sensor 23 can detect only the load applied from above the lever 10. Accordingly, even when the types of the lever 10 or jig plate 50 and the types and number of ferrules W are changed, the polishing load can be detected accurately.

In the drawing, the lever 10, the upper spring 22, the pressing head 21, the pressure sensor 23, and the lower spring 24 are configured of a part of the pressing part 20.

Here, under the polishing sheet 70, the elastic member 71 made of a rubber sheet is disposed for use in forming a convex surface. Under the elastic member 71 or near the polishing plate 60, a heater 61 such as silicon rubber heater or film heater is disposed, whereby the temperatures of the rubber sheet can be kept constant, and the hardness of the rubber sheet can be varied softer or harder, allowing changes in polishing condition, pressure conditions, and conditions for finishing and lapping. In addition, it is also possible to adjust changes in the elasticity of the rubber sheet over time to prolong the lifetime. The formation of the rubber sheet is a varied, whereby the end face shape of the rodshaped member can be formed flat or formed to have convex surfaces, allowing flat polishing, APC polishing, and PC polishing. Furthermore, instead of the heater 61, it is possible that a cooling device 62 formed of a cooling pipe having water or a cooling medium communicated inside thereof, or of a bismuth-tellurim based Peltier element is disposed to cool the rubber sheet and the hardness is varied. Other than this, it is also possible that an infrared heater or cooling pipe is disposed from above the jig plate 50 to control temperatures. Besides, both mechanisms for cooling and heating are disposed to control temperatures more accurately and in the wider temperature range, whereby the end face shape can be finished precisely.

Next, FIG. 2 shows the pressing part 20.

The pressing part 20 has a mechanism for reciprocating the lever 10. The lever 10 is connected to the pressing head 21 through the pressure sensor 23 for detecting pressure, and the pressing head 21 and the lever 10 are moved vertically by the rotation of a screw 26, which servers to transmit the force to press the lever 10 to the jig plate 50.

The lever 10 is provided with a guide 28 so as to accurately reciprocate vertically. For the guide 28, a linear guide arranged in parallel to the axis of the upper spring 22 or lower spring 24 is used. Accordingly, detecting the pressure due to the transverse movement of the lever 10 can be eliminated to allow improving the SN ratio.

The screw 26 transmits the rotation of a motor 25 through a shaft 25*a*, a pulley 27*a*, a belt 29, and a pulley 27*b* for rotation, and then it moves the lever 10 vertically. The pressure sensor 23 detects the load applied by the rotation of the motor 25, and a pressing force control part 40 feeds electric power for driving the motor 25 to configure a pressing force control circuit.

FIG. 3 shows the pressing force control part 40. The pressing force control part 40 includes an A/D converter 33 for converting the output of the pressure sensor 23, a first storage device 34 for storing a control program, a second storage device 35 for storing set pressures, a CPU 37 for comparing and operating detected values and predetermined pressure values and for determining output data for driving the motor 25, in which the output of the CPU 37 is converted by a D/A converter 36, and the output is inputted to a driver 44, and the electric power for driving the motor 25 is outputted. Here, the CPU 37 is connected to a serial interface 38, and it interconnects a polishing control machine 39 and a server by protocols such as TCP/IP, wireless LAN, and bluetooth in the connection of an RS-232C, a USB, and a 100 base. Therefore, the polishing machine is downloaded with programs for polishing conditions or with polishing conditions, allowing delivery of the polishing conditions optimal for user conditions.

According to the invention, pressure applied to the end part of the ferrule can be controlled so as to be a predetermined set value. Consequently, the load applied to the ferrule end part can be kept constant in polishing.

Furthermore, in the initial polishing state of the ferrule, when the end part of an optical fiber is exposed from the ferrule end part, the load is reduced to have the optical fiber end face and the ferrule end face in a nearly equal plane. When cracks or chips are not generated in the optical fiber end part, the polishing load is increased to allow rapid polishing. Here, switching loads is also feasible by a method of specifying them by a timer inside the pressing force control part 40, or a method of operating values of a real time clock. In addition, it is possible that the electric power of the motor 25 or the electric power of the motor for driving the polishing plate 60 is detected, and the drive load of the motor detects the start of polishing the ferrule end part, i.e. the state that the initial polishing of the optical fiber end part is finished to be in the same plane as the ferrule.

Moreover, as another method for detecting the polished state, the relationship between the feed of the screw 26 and changes in pressure can determine the contact state of the ferrule end part to the polishing sheet 70 according to the relationship between the drive of the motor 25 and the output of the pressure sensor 23. This method can detect the point of matching the optical fiber end face with the ferrule end face and the generation of cracks or chips in the optical fiber. When pressure values equal to or above the specified values are detected, it is determined abnormal to stop operations of the polishing machine, and waste time due to polishing defectives can be reduced.

Besides, the pressure values for polishing loads to be set are reduced as the steps proceed, a greater value in rough finish to be reduced in middle finish and then in fine finish, allowing the improvement in polishing rates and preventing polishing scratches from being generated.

In addition to this, according to differences in the types and particle diameters of abrasives, and differences in the materials, end face shape and diameters of ferrules, pressure to be set can be varied, and the object optimal conditions can be selected.

Furthermore, pressure in pressing is slightly varied to apply shifts in the vertical direction of the ferrule by free decay vibration or forced vibration, or pressure variations are applied to give modulation in the vertical direction, whereby changes in elasticity, complex elastic modules, and dynamic elastic modules due to modulation frequencies and a magnitude of pressure changes or phase shifts allow monitoring the degraded states of the polishing sheet or changes in the polishing state. Moreover, the temperatures near the polishing sheet are kept constant by the heater, whereby polishing monitor based on changes in elastic modules can be performed from the relationship between a logarithm LOG (F) for a modulation frequency F and an inverse number 1/(T) for a temperature absolute value T, allowing variations in the polishing states to be reduced, and yields to be controlled from remote locations.

FIG. 4 shows a diagram illustrating the jig plate 50 of the invention. Two ferrules W are clamped with a fixing block 51 against each side of a hexagon for fixing.

Figure 5:
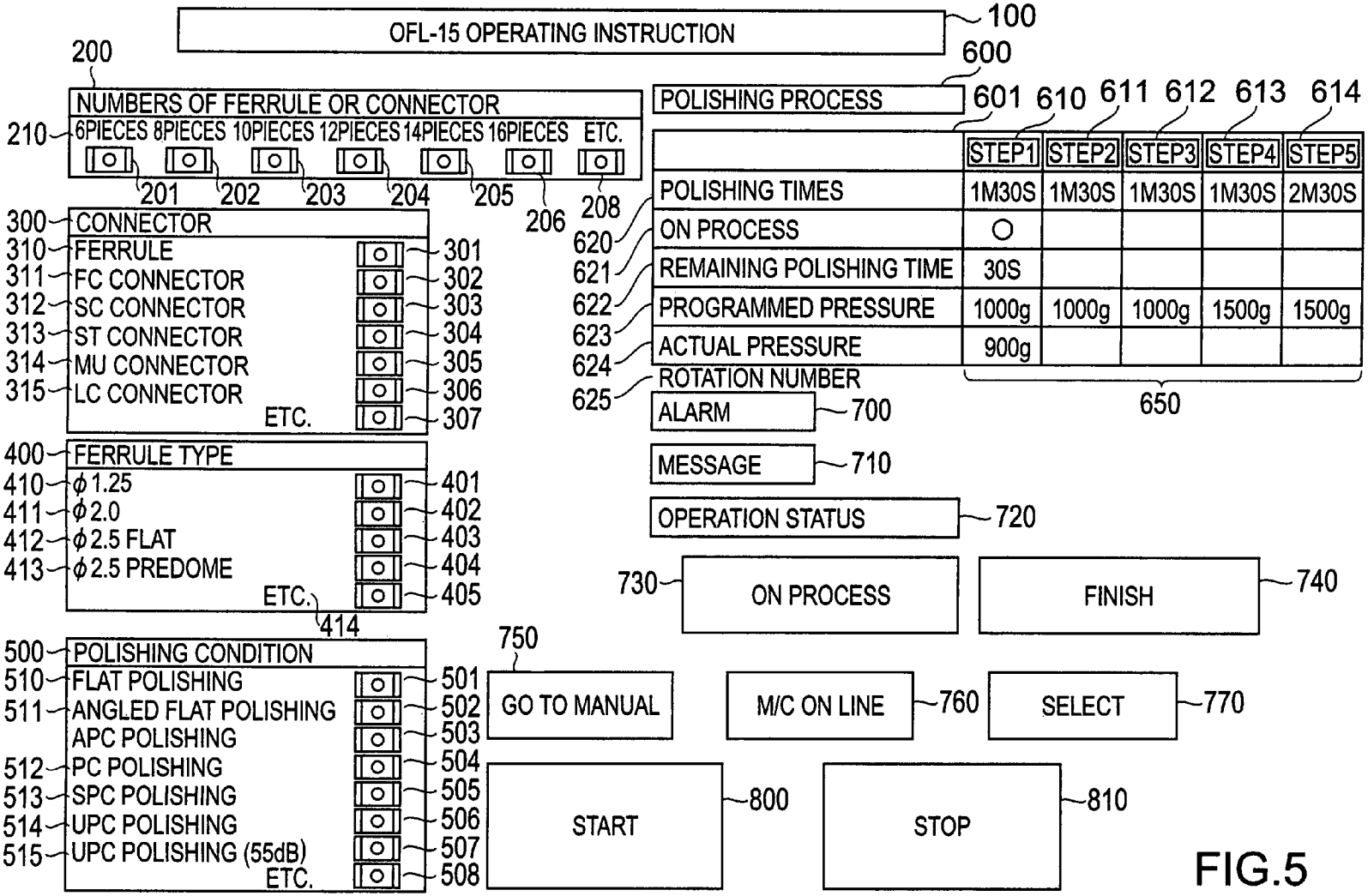
FIG. 5 is a diagram illustrating a display part of a control machine in the polishing system of the invention.

FIG. 5 is a diagram illustrating a display part in a control machine in the polishing system of the invention. At the lower left of a title 100, a numbers indication part 200 for indicating the number of ferrules polished simultaneously has input buttons 201, 202, 203, 204, 205, 206 and 208 for inputting six to sixteen ferrules or the number other than these, and a pieces indication 210. Here, the input button 201 has inputted six ferrules, and thus the pieces input button in 210 is indicated in red. A type indication part 300 for indicating connector types is under the numbers indication part 200. Disposed are type indications for indicating Ferrule only, FC Connector, SC Connector, ST Connector, MU Connector, and LC Connector and other than these, and input buttons 301, 302, 303, 304, 305, 306 and 307 corresponding to each of them; Ferrule is selected to indicate the input button 301 in red.

Furthermore, a type indication part 400 for indicating ferrule shapes has type indications 410, 411, 412, 413, and 414 for indicating ϕ 1.25, ϕ 2.0, ϕ 2.5 Flat, ϕ 2.5 Predome, and the others. When input buttons 401, 402, 403, 404 and 405 corresponding thereto are inputted, the selected button turns red.

In addition, a condition indication part 500 has condition indications for indicating FLAT Polishing, ANGLED FLAT Polishing, APC Polishing, PC Polishing, SPC Polishing, UPC Polishing, and UPC 55 dB Polishing, and input buttons 501, 502, 503, 504, 505, 506, 507 and 508 for selecting and indicating each condition.

Moreover, a process indication part 600 for indicating polishing processes displays a process table 601. Disposed are process step indication parts 610, 611, 612, 613 and 614 for indicating a first polishing step to a fifth polishing step, and item indications for indicating process conditions for each of steps and parameters: a polishing time 620 for indicating process time for each step, an on process 621 for indicating the step now being implemented, a remaining polishing time 622 for indicating remaining time for each step, a programmed pressure 623 for setting a polishing pressure, an actual pressure measurement 624 for indicating measurements of pressure actually applied, and a rotation number 625 for indicating the rotation number of the polishing plate.

Besides, a condition input and indication part 650 indicates values for indicating the polishing conditions to be set and actual numeric values, also serving as an input screen.

In addition to these, there are an alarm 700 for signaling abnormal circumstances, an indication part for a massage 710, an operation status 720 for indicating operation states, an on process indication 730 for indicating during polishing, a finish indication 740 for indicating the completion of polishing, a manual switch 750 for switching operation modes, an online control 760 for indicating an online state, and a select indication 770 for indicating selections.

There are a start button 800 for initiating the operation of the polishing machine to start the polishing process after the settings are performed, and a stop button 810 for indicating stop operation.

The input method of the polishing conditions are that a ferrule type, ϕ 1.25 mm, for example, is first selected, and then the ferrule polishing condition is selected for APC polishing. Here, the polishing process steps and polishing time for each step are determined. Subsequently, the number of ferrules fixed to the jig is selected. The manipulations described above determine the load applied by the polishing machine.

In addition to this, a rotation control part for controlling the rotation speed of rotation and revolution for the polishing plate and a rotation number input part for inputting the rotation number to the rotation control part are disposed to control the rotation number of the polishing plate other than polishing pressure and polishing time, whereby further accurate end face polishing can be performed.

Examples of input by each button, changes in the display colors of the buttons, and indications by lighting have been described so far, but addition of a speech generation device or speech recognition process may allow speech input, speech announce, and calling attention.

Furthermore, the window size, arrangement, and screen switching of each indication part can be performed freely such that the display screens are rotated forward by the hour and that actual values in process conditions are displayed in graph to indicate a red line for easy observation of variations in status when a greater undershoot or overshoot causes a large deviation from the set value. Moreover, when particularly abnormal circumstances are generated, the control machine allows e-mail transmission to a cellular phone that an operator in charge has or another terminal that the operator has for sure emergency stop.

In this manner, according to the end face polishing machine of the invention, the control of a pressure in pressing the end face of the ferrule W onto the polishing sheet 70 is allowed. When the pressure in pressing the end face of the ferrule W is set low in starting polishing, scratches on the end face of the ferrule W can be prevented from being generated.

According to the invention, the polishing operation status such as the number of products can be decided and controlled from remote locations immediately because of the connection to the communication system through the LAN or Internet. Furthermore, the process management and production control over the respective factories having a plurality of subunits are allowed to facilitate the overall time management from order to production. Moreover, order and accounting systems are connected to complete the production control system for the overall factories.

Besides, variations in row material properties due to material lots of ferrules, and variation due to polishing media, temperatures, humidities, frictions of the polishing machine, and moments of the jig are finely adjusted, allowing improvement in yields.

What is claimed is:

1. A ferrule polishing control machine comprising:

a ferrule type input part for selecting one type of ferrule from a plurality of ferrule types stored in a computer;

a ferrule end face shape input part for selecting one type of ferrule end face shape from a plurality of types of ferrule end face shapes stored in the computer;

a connector type input part for selecting one type of connector from a plurality of connector types stored in the computer;

a ferrule polishing number input part for selecting from a plurality of ferrule polishing numbers stored in the computer a number of ferrules to be mounted on a polishing jig for a polishing operation; and a transmitting part for selecting polishing pressure information stored in the computer in accordance with polishing information inputted from the ferrule type input part, the ferrule end face shape input part, the connector type input part, and the ferrule polishing number input part, and for transmitting the polishing pressure information to a ferrule polishing machine.

2. A polishing system comprising: a ferrule polishing control machine according to claim 1 and a ferrule polishing machine for receiving the polishing pressure information transmitted by the transmitting part of the ferrule polishing control machine for polishing the end face of the ferrule or the end faces of the ferrules.

3. A ferrule polishing method comprising the steps of:

selecting one type of ferrule from a plurality of ferrule types stored in a computer;

selecting one type of ferrule end face shape from a plurality of types of ferrule end face shapes stored in the computer;

selecting one type of connector from a plurality of connector types stored in the computer;

selecting from a plurality of ferrule numbers stored in the computer a number of ferrules to be mounted on a polishing jig for a polishing operation; and selecting polishing pressure information stored in the computer in accordance with the type of ferrule selected, the type of ferrule end face shape selected, and the number of ferrules selected for polishing the end face of the ferrule or end faces of the ferrules.

4. A ferrule polishing method according to claim 3, further comprising the steps of transmitting the selected polishing pressure information to a ferrule polishing machine; and polishing the end face of the ferrule or the end faces of the ferrules using the polishing machine.

5. A computer-readable storage medium storing a ferrule polishing computer program comprising the steps of:

selecting one type of ferrule from a plurality of ferrule types stored in a computer;

selecting one type of ferrule end face shape from a plurality of types of ferrule end face shapes stored in the computer;

selecting one type of connector from a plurality of connector types stored in the computer;

selecting a number of ferrules to be mounted on a polishing jig from a plurality of numbers stored in the computer; and selecting polishing pressure information stored in the computer in accordance with the type of ferrule selected by the first selecting means, the type of ferrule end face shape selected by the second selecting means, and the number of ferrules selected by the third selecting means for polishing the end face of the ferrule or end faces of the ferrules.

6. A computer-readable storage medium storing a ferrule polishing computer program according to claim 5 wherein the computer program further comprises the step of transmitting the selected polishing pressure information to a ferrule polishing machine for polishing the end face of the ferrule or the end faces of the ferrules using the polishing machine.

* * * * *